US009607497B1

(12) United States Patent
Cronin

(10) Patent No.: US 9,607,497 B1
(45) Date of Patent: Mar. 28, 2017

(54) WIRELESS COMMUNICATION SECURITY SYSTEM

(71) Applicant: ProSports Technologies, LLC, Miami, FL (US)

(72) Inventor: John E. Cronin, Bonita Springs, FL (US)

(73) Assignee: ProSports Technologies, LLC, Miami, FL (US)

( * ) Notice: Subject to any disclaimer, the term of this patent is extended or adjusted under 35 U.S.C. 154(b) by 0 days.

(21) Appl. No.: 14/818,226

(22) Filed: Aug. 4, 2015

Related U.S. Application Data

(60) Provisional application No. 62/041,220, filed on Aug. 25, 2014.

(51) Int. Cl.

| | |
|---|---|
| ***G08B 1/08*** | (2006.01) |
| ***G08B 21/02*** | (2006.01) |
| ***G08B 25/01*** | (2006.01) |
| ***G08B 27/00*** | (2006.01) |
| *G06Q 50/26* | (2012.01) |

(52) U.S. Cl.
CPC ..... *G08B 21/02* (2013.01); *G08B 25/016* (2013.01); *G08B 27/001* (2013.01); *G06Q 50/265* (2013.01)

(58) Field of Classification Search
CPC ..... G08B 21/02; G08B 21/10; G08B 25/00; G08B 25/016; G08B 25/08; G08B 27/00; G08B 27/001
See application file for complete search history.

(56) References Cited

U.S. PATENT DOCUMENTS

| | | | | |
|---|---|---|---|---|
| 6,329,919 | B1 | 12/2001 | Boies et al. | |
| 6,778,085 | B2 * | 8/2004 | Faulkner | G08B 13/19656 340/541 |
| 7,671,730 | B2 * | 3/2010 | Henderson | G08B 17/125 340/426.1 |

(Continued)

FOREIGN PATENT DOCUMENTS

| | | |
|---|---|---|
| CN | 102843186 | 12/2012 |
| KR | 10-1133539000 | 4/2012 |
| WO | WO 2009/104921 | 8/2009 |

OTHER PUBLICATIONS

U.S. Appl. No. 14/798,210, John Cronin, Restroom Queue Management, filed Jul. 13, 2015.

(Continued)

*Primary Examiner* — Steven Lim
*Assistant Examiner* — Ryan Sherwin
(74) *Attorney, Agent, or Firm* — Polsinelli LLP

(57) ABSTRACT

An event venue, such as a sports stadium, can use a security system to wireless communicate about security issues. The event venue may have one or more wireless transmitters with transmission zones within the event venue. When a central security office system receives a security alert from a device belonging to a security guard or an eventgoer, or from a law enforcement or first responder network, or from security cameras or emergency beacons (e.g., a fire alarms), information detailing the security issue can be composed into an electronic message, which may include camera footage. The electronic message can then be sent out to at least a subset of the devices in the event venue using the wireless transmitters, for example to summon security guards to deal with a brawl, or to warn eventgoers of a fire.

18 Claims, 7 Drawing Sheets

(56) References Cited

U.S. PATENT DOCUMENTS

| | | | | |
|---|---|---|---|---|
| 7,715,723 | B2 | 5/2010 | Kagawa et al. | |
| 7,724,131 | B2 * | 5/2010 | Chen | G08B 25/006 340/506 |
| 7,778,855 | B2 | 8/2010 | Holliday | |
| 7,929,867 | B2 | 4/2011 | Nakagawa | |
| 7,970,537 | B2 | 6/2011 | Ann et al. | |
| 8,126,782 | B1 | 2/2012 | Zhu et al. | |
| 8,188,878 | B2 | 5/2012 | Pederson et al. | |
| 8,275,096 | B2 * | 9/2012 | Neece | H04M 3/5116 340/541 |
| 8,589,667 | B2 | 11/2013 | Mujtaba et al. | |
| 8,611,930 | B2 | 12/2013 | Louboutin et al. | |
| 8,620,344 | B2 | 12/2013 | Huang et al. | |
| 8,626,465 | B2 | 1/2014 | Moore et al. | |
| 8,630,216 | B2 | 1/2014 | Deivasigamani et al. | |
| 8,660,501 | B2 | 2/2014 | Sanguinetti | |
| 8,706,044 | B2 | 4/2014 | Chang et al. | |
| 8,724,723 | B2 | 5/2014 | Panicker et al. | |
| 8,750,207 | B2 | 6/2014 | Jeong et al. | |
| 8,789,175 | B2 * | 7/2014 | Hubner | G08B 25/001 726/22 |
| 8,793,094 | B2 | 7/2014 | Tam et al. | |
| 8,816,868 | B2 | 8/2014 | Tan et al. | |
| 8,831,529 | B2 | 9/2014 | Toh et al. | |
| 8,831,655 | B2 | 9/2014 | Burchill et al. | |
| 8,836,851 | B2 | 9/2014 | Brunner | |
| 8,843,158 | B2 | 9/2014 | Nagaraj | |
| 8,849,308 | B2 | 9/2014 | Marti et al. | |
| 8,862,060 | B2 | 10/2014 | Mayor | |
| 8,863,172 | B2 * | 10/2014 | Hardin | H04N 21/2385 725/32 |
| 8,873,418 | B2 | 10/2014 | Robinson et al. | |
| 8,874,090 | B2 | 10/2014 | Abuan et al. | |
| 8,917,632 | B2 | 12/2014 | Zhou et al. | |
| 8,934,921 | B2 | 1/2015 | Marti et al. | |
| 9,054,800 | B2 * | 6/2015 | Suresh | H04B 10/116 |
| 2002/0167408 | A1 | 11/2002 | Trajkovic et al. | |
| 2003/0014749 | A1 | 1/2003 | Simons et al. | |
| 2003/0036936 | A1 | 2/2003 | Steichen et al. | |
| 2006/0273920 | A1 | 12/2006 | Doan et al. | |
| 2009/0112638 | A1 | 4/2009 | Kneller et al. | |
| 2009/0249342 | A1 | 10/2009 | Johnson | |
| 2009/0319306 | A1 | 12/2009 | Chanick | |
| 2010/0141480 | A1 | 6/2010 | Brooks et al. | |
| 2012/0116863 | A1 | 5/2012 | Boss et al. | |
| 2012/0154169 | A1 | 6/2012 | Hoekstra | |
| 2012/0207350 | A1 | 8/2012 | Loos | |
| 2012/0315868 | A1 | 12/2012 | Ben-Alexander | |
| 2013/0126713 | A1 | 5/2013 | Haas et al. | |
| 2013/0141555 | A1 | 6/2013 | Ganick et al. | |
| 2013/0183924 | A1 * | 7/2013 | Saigh | H04W 4/025 455/404.2 |
| 2013/0211715 | A1 | 8/2013 | Bae et al. | |
| 2013/0279917 | A1 | 10/2013 | Son et al. | |
| 2013/0303192 | A1 | 11/2013 | Louboutin | |
| 2013/0317835 | A1 | 11/2013 | Mathew | |
| 2013/0328917 | A1 | 12/2013 | Zambetti | |
| 2013/0331087 | A1 | 12/2013 | Shoemaker | |
| 2013/0331118 | A1 | 12/2013 | Chhabra | |
| 2013/0331137 | A1 | 12/2013 | Burchill | |
| 2013/0332108 | A1 | 12/2013 | Patel | |
| 2013/0332156 | A1 | 12/2013 | Tackin | |
| 2013/0332208 | A1 | 12/2013 | Mehta | |
| 2013/0336662 | A1 | 12/2013 | Murayama et al. | |
| 2013/0343762 | A1 | 12/2013 | Murayama et al. | |
| 2014/0055619 | A1 | 2/2014 | Holland et al. | |
| 2014/0062773 | A1 | 3/2014 | MacGougan | |
| 2014/0065962 | A1 | 3/2014 | Le | |
| 2014/0071221 | A1 | 3/2014 | Dave | |
| 2014/0072119 | A1 * | 3/2014 | Hranilovic | H04L 9/3215 380/270 |
| 2014/0105084 | A1 | 4/2014 | Chhabra | |
| 2014/0132400 | A1 | 5/2014 | Heaven et al. | |
| 2014/0139380 | A1 | 5/2014 | Ouyang | |
| 2014/0141803 | A1 | 5/2014 | Marti | |
| 2014/0162628 | A1 | 6/2014 | Bevelacqua | |
| 2014/0167794 | A1 | 6/2014 | Nath | |
| 2014/0168170 | A1 | 6/2014 | Lazarescu | |
| 2014/0171114 | A1 | 6/2014 | Marti | |
| 2014/0180820 | A1 | 6/2014 | Louboutin | |
| 2014/0191979 | A1 | 7/2014 | Tsudik | |
| 2014/0200053 | A1 | 7/2014 | Balasubramanian | |
| 2014/0222335 | A1 | 8/2014 | Piemonte | |
| 2014/0232633 | A1 | 8/2014 | Shultz | |
| 2014/0232634 | A1 | 8/2014 | Piemonte | |
| 2014/0241730 | A1 | 8/2014 | Jovicic et al. | |
| 2014/0247279 | A1 | 9/2014 | Nicholas | |
| 2014/0247280 | A1 | 9/2014 | Nicholas | |
| 2014/0269562 | A1 | 9/2014 | Burchill | |
| 2014/0274150 | A1 | 9/2014 | Marti | |
| 2014/0283135 | A1 | 9/2014 | Shepherd | |
| 2014/0293959 | A1 | 10/2014 | Singh | |
| 2014/0363168 | A1 | 12/2014 | Walker | |
| 2014/0364089 | A1 | 12/2014 | Lienhart | |
| 2014/0364148 | A1 | 12/2014 | Block | |
| 2014/0365120 | A1 | 12/2014 | Vulcano | |
| 2014/0375217 | A1 | 12/2014 | Feri et al. | |
| 2015/0011242 | A1 | 1/2015 | Nagaraj | |
| 2015/0026623 | A1 | 1/2015 | Horne | |
| 2015/0031397 | A1 | 1/2015 | Jouaux | |
| 2015/0038171 | A1 | 2/2015 | Uilecan et al. | |
| 2015/0049190 | A1 * | 2/2015 | Galvez | G08B 13/196 348/143 |
| 2015/0137986 | A1 * | 5/2015 | Kang | G08B 25/08 340/691.8 |
| 2016/0005053 | A1 | 1/2016 | Klima et al. | |

OTHER PUBLICATIONS

U.S. Appl. No. 14/731,810, John Cronin, Concession Management, filed Jun. 5, 2015.

U.S. Appl. No. 14/798,291, John Cronin, Queue Information Transmission, filed Jul. 13, 2015.

U.S. Appl. No. 14/732,394, John Cronin, Wireless Concession Delivery, filed Jun. 5, 2015.

Bandela et al.; Praveen; "Li-Fi (Light Fidelity): The Next Generation of Wireless Network", International Journal of Advanced Trends in Computer Science and Engineering, vol. 3, No. 1, pp. 132-137 (2014).

Blau, John; "Security wins at German soccer stadium", Network World, Mar. 7, 2006.

Burchardt, Harald; "A Proposed Architecture for Short "Rolling Shutter" Messages", IEEE P802.15, Wireless Personal Area Networks, Mar. 2014.

"Challenge iBeacon Philips Smart LED communication system to locate commercial indoor lighting", by Sunricher, Feb. 18, 2014.

"Create Innovative Services with Play APPs", Date of Download: Jan. 16, 2014, http://www.oledcomm.com/LIFI.html, Oledcomm—France LiFi.

"Customer Retail Analytics", Nanuka Digital Solutions, Jun. 2, 2014.

Danakis, C et al.; "Using a CMOS Camera Sensor for Visible Light Communication"; 3rd IEEE Workshop on Optical Wireless Communications; [online], Dec. 3-7, 2012 [retrieved Aug. 14, 2015]. Retrieved from the Internet: <URL:https://195.134.65.236/IEEE_Globecom_2012/papers/p1244-danakis.pdf> pp. 1244-1248.

Dawson, Keith; "LiFi in the Real World" All LED Lighting—Illuminating The Led Community, Jul. 31, 2013.

Eng, James; "Beer lines at 49ers stadium: There's an app for that", MSN News, Jul. 31, 2013.

"Get the Conversion Advantage With LightHause Visual Customer Intelligence", Visual Customer Intelligence, Sep. 16, 2012.

Gorman, Michael; "Outstanding Technology brings visible light communication to phones and tablets via dongle and LEDs", Edgadget International Editions, Jul. 16, 2012.

Haas, Harald; "Delivering safe and secure wireless communications", pureLiFi. Date of download: Jan. 16, 2014 http://purelifi.co.uk/.

(56) References Cited

OTHER PUBLICATIONS

Kumar, Navin; "Visible Light Communications Systems Conception and VIDAS", IETE Technical Review, vol. 25, Issue 6, Nov.-Dec. 2008. Date of download: Nov. 19, 2009. http://www.tr.ietejournals.org.
Li, Yang et al., "VICO: A Framework for Configuring Indoor Visible Light Communication Networks" Aug. 11, 2012, Mobile Adhoc and Sensor Systems (MASS), 2012 IEEE 9th International Conference, Las Vegas, NV.
LiFi Overview—Green wireless mobile communication—LiFi Technology. Date of download: Jan. 16, 2014.
LIGHTimes Online—LED Industry News,Jun. 17, 2014.
Montero, Eric, "Design and Implementation of Color-Shift Keying for Visible Light Communications", Sep. 2013, McMaster University.
"Nextiva Retail Traffic Analytics—Understanding Shopper Behavior to Improve Sales and the Customer Experience", Verint. Video Intelligence Solution. Aug. 2010.
Nguyen et al., "A Novel like switching scheme using pre-scanning and RSS prediction in visible light communication networks", EURASIP Journal on Wireless Communications and Networking, 2013.
Ogawa; "Article about VLC Guidance developed", Visible Light Communications Consotium (VLCC), Aug. 31, 2012.
Ogawa; "iPhone app from CASIO", Visible Light Communications Consotium (VLCC), Apr. 26, 2012.
Povey, Gordon, "VLC for Location, positioning and navigation", Jul. 27, 2011, http://visiblelightcomm.com/vlc-for-location-positioning-and-n . . . .
"Smart lights help shoppers find groceries", Lux Magazine, Feb. 19, 2014.
Thanigavel, M.; "Li-Fi Technology in Wireless Communication", International Journal of Engineering Research & Technology (IJERT), ISSN: 2278-0181, vol. 2 Issue 10, Oct. 2013.
TrueView Queue—Manual, Embedded for Axis IP cameras, version 1.0, Mar. 7, 2014.
Valinsky, Jordan; "Madison Square Garden May Add a Bathroom Wait Time App So At Least You Can Enjoy Some Sort of Victory", Betabeat, Oct. 22, 2013.
Video Analytics: Understanding Rules and Exception-based Reporting—A 3xLOGIC Discussion Guide, Intelligent Video Surveillance. Oct. 19, 2011.
Won, Eun Tae; "Visible Light Communication: Tutorial", Project: IEEE P802.15 Working Group for Wireless Personal Area Networks (WPANs), Mar. 9, 2008.
PCT Application No. PCT/US2015/033613 International Search Report and Written Opinion mailed Sep. 1, 2015.
U.S. Appl. No. 14/798,210 Office Action mailed Oct. 16, 2015.
U.S. Appl. No. 14/798,291 Office Action mailed Nov. 17, 2015.
U.S. Appl. No. 14/798,210 Final Office Action mailed Apr. 27, 2016.
U.S. Appl. No. 14/798,291 Final Office Action mailed Jun. 17, 2016.
U.S. Appl. No. 14/798,210 Office Action mailed Jan. 5, 2017.

* cited by examiner

WIRELESS COMMUNICATION SECURITY SYSTEM

CROSS-REFERENCE TO RELATED APPLICATIONS

The present application claims the priority benefit of U.S. provisional application No. 62/041,220 filed Aug. 25, 2014 entitled "VLC Security System," the disclosure of which is hereby incorporated by reference.

BACKGROUND

Field of Invention

The present invention generally relates to event venue security systems. More specifically, the present invention relates to event venue security systems that wirelessly transmit security information to security personnel and to eventgoers.

Description of the Related Art

Event venues, such as sports stadiums or arenas, typically hire security guards during large events. The security guards are used to maintain order in the face of sometimes-troublesome eventgoers, such as rowdy sports fans. Security guards can be used to ensure that eventgoers sit in their assigned seats, do not fight or brawl, do not steal from concession sellers, do not interfere with the event being shown, do not record the event if photography/recording is prohibited, and do not sneak in to the event venue without a ticket.

Some event venues include basic security systems, such as cameras, to help identify potential trouble spots from a variety of helpful vantage points to help direct security guards where they are needed or could be useful. Typically, these cameras output camera feeds to a single security office to be monitored by a security manager, who may communicate with security guards using a radio communication device (e.g., a "walkie-talkie") generally without knowing where individual security guards are currently located. The security guard generally never sees the camera footage and must rely on the security manager's description. The security guard sometimes might not hear his or her radio communication device, particularly in the loud noise that sometimes accompanies a panic-inducing security event such as a brawl or a fire.

Traditionally, the field of digital communications includes wired and wireless transfer of information. Digital communications may include direct communications in which information is transmitted from a sender device to a recipient device, and may also include "indirect" communications in which information is transmitted from a sender device, through one or more "intermediary" or "middleman" devices, and eventually to a recipient device.

One example of wired transfer includes data transmitted from a sender device to a recipient device using a Universal Serial Bus (USB) cable. Another example of a wired transfer includes data transmitted within a private Local Area Network (LAN) from a sender device to a router through a sender Ethernet cable, and from the router to a recipient device through a recipient Ethernet cable.

One example of wireless transfer includes data transmitted from a sender device to a recipient device using a Bluetooth protocol connection. Another example of a wired transfer includes data transmitted within a private Wireless Local Area Network (WLAN) from a sender device to a router through a wireless Wi-Fi connection, and from the router to a recipient device through a wireless Wi-Fi connection. Other examples of wireless transfer include Bluetooth communications, Visible Light Communications (VLC), radio wave communications, microwave communications, or sonic communication.

Thus, an improved event venue security system with wireless communication capabilities is needed.

SUMMARY OF THE CLAIMED INVENTION

One exemplary method for event venue security includes receiving a security alert identifying a security issue at an event venue. The method also includes generating an electronic message identifying the security issue. The method also includes identifying a transmission region, the transmission region covering at least a subset of the event venue. The method also includes transmitting the electronic message using one or more wireless transmitters to one or more receiver devices within the transmission region.

One exemplary system for event venue security includes one or more wireless transmitters and a security management device. Execution of instructions stored in a memory of the security management device by a processor of the security management device performs various system operations. The system operations include receiving a security alert identifying a security issue at an event venue. The system operations also include generating an electronic message identifying the security issue. The system operations also include identifying a transmission region, the transmission region covering at least a subset of the event venue. The system operations also include transmitting the electronic message using one or more wireless transmitters to one or more receiver devices within the transmission region.

One exemplary non-transitory computer-readable storage medium is also described, the non-transitory computer-readable storage medium having embodied thereon a program executable by a processor to perform an exemplary program method for event venue security that includes receiving a security alert identifying a security issue at an event venue. The program method also includes generating an electronic message identifying the security issue. The program method also includes identifying a transmission region, the transmission region covering at least a subset of the event venue. The program method also includes transmitting the electronic message using one or more wireless transmitters to one or more receiver devices within the transmission region.

DETAILED DESCRIPTION

An event venue, such as a sports stadium, can use a security system to wireless communicate about security issues. The event venue may have one or more wireless transmitters with transmission zones within the event venue. When a central security office system receives a security alert from a device belonging to a security guard or an eventgoer, or from a law enforcement or first responder network, or from security cameras or emergency beacons (e.g., a fire alarms), information detailing the security issue can be composed into an electronic message, which may include camera footage. The electronic message can then be sent out to at least a subset of the devices in the event venue using the wireless transmitters, for example to summon security guards to deal with a brawl, or to warn eventgoers of a fire.

Figure 1:
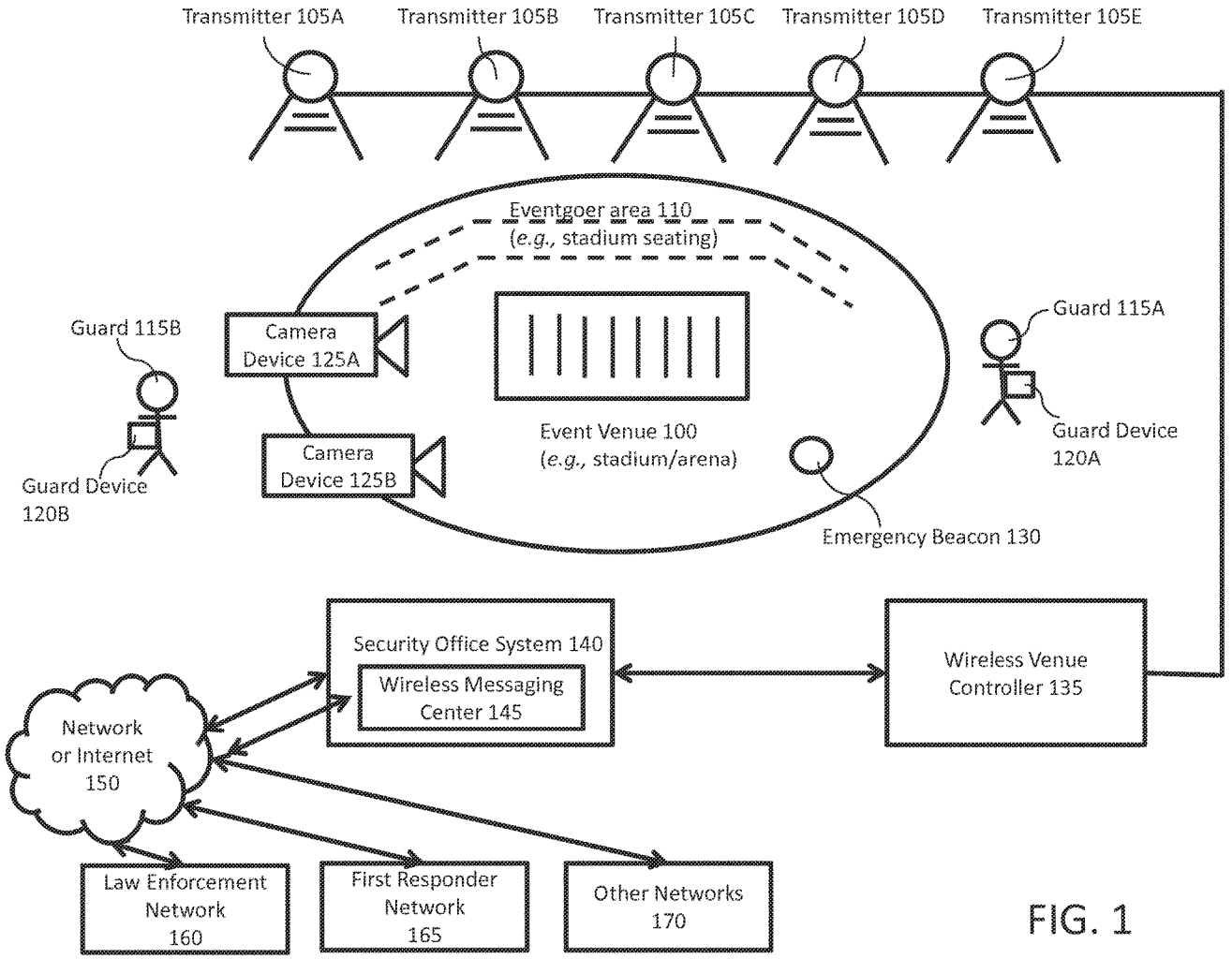
FIG. 1 illustrates an exemplary wireless event venue security system ecosystem.

FIG. 1 illustrates an exemplary wireless event venue security system ecosystem.

The wireless event venue security system ecosystem of FIG. 1 includes an event venue 100. The event venue 100 may be any type of event venue used to host any type of event, public or private. For instance, the event venue may be a venue for any type of entertainment or cultural events that are presented at a theater, gymnasium, church, stadium, or other facility to a group of people. Such events include a wide variety of sporting events such as football (American and Global), baseball, basketball, soccer, ice hockey, lacrosse, rugby, cricket, tennis, track and field, golf, cycling, motor sports such as automobile or motorcycle racing, horse racing, Olympic games, and the like; cultural events such as concerts, music festivals, plays, or the opera, and the like; religious events; and more permanent exhibitions such as a museum, historic home, and the like.

The event venue 100 of FIG. 1 includes an eventgoer area 110, which may include, for example, stadium seating, bleachers, theater seating, or a "standing room" general eventgoer area.

The wireless event venue security system ecosystem of FIG. 1 includes two guards, identified as guard 115A and guard 115B. Other event venues may have more or fewer guards. Both guards in FIG. 1 have a guard device. The guard 115A has a guard device 120A and the guard 115B has a guard device 120B. Each guard device The wireless event venue security system ecosystem of FIG. 1 includes an emergency beacon 130, which may be a site at which an individual (e.g., an eventgoer, a performer, a sports athlete) can obtain emergency help. For example, the emergency beacon 130 may include a first aid kit, an activator for an alarm or siren, or a mechanism (e.g., a phone or button or switch) for contacting law enforcement (e.g., local police forces, federal law enforcement agencies, or international law enforcement agencies), firefighters, paramedics, or other emergency service providers.

The wireless event venue security system ecosystem of FIG. 1 includes two guards 115, identified as guard 115A and guard 115B. Other event venues may have more or fewer guards 115. Both guards 115 in FIG. 1 have a guard device 120. The guard 115A has a guard device 120A and the guard 115B has a guard device 120B. Each guard device 115 may be a computing device 700 or a device with a subset of components that might be found in a computing device 700, and may for example be a smartphone device, a tablet device, a laptop computer device, a portable media player device, a portable video game console device, or a portable e-book reader device. Each guard device 120 may be capable of receiving and/or transmitting wireless data. The guard devices 120 are further described in FIG. 3.

The wireless event venue security system ecosystem of FIG. 1 includes two camera devices 125, identified as camera device 125A and camera device 125B. The camera devices 125 include at least a camera capable of taking photographs, video, or both. The photographs and video captured by the camera devices 125 may be captured over a light capture spectrum that includes at least part of the visible light spectrum, and may also (or alternately) include at least part of the infrared light spectrum or ultraviolet light spectrum. The camera devices 125 may include other elements, such as a microphone and a variety of sensors (e.g., motion sensor, thermometer, humidity sensor, smoke detector, pollution sensor, allergen sensor). The camera devices 125 may also include at least a subset of components that might be found in a computing device 700, such as a memory system 720, a mass storage system 730, a portable storage system 740, a processor 710, a display system 770, or some combination thereof. Each camera device 125 may record its captured camera feed on a memory system 720, a mass storage system 730, a portable storage system 740, or an analog visual storage medium such as a videotape or a negative. Each camera device 125 may be capable of receiving and/or transmitting wireless data. The camera devices 125 are further described in FIG. 3.

Figure 3:
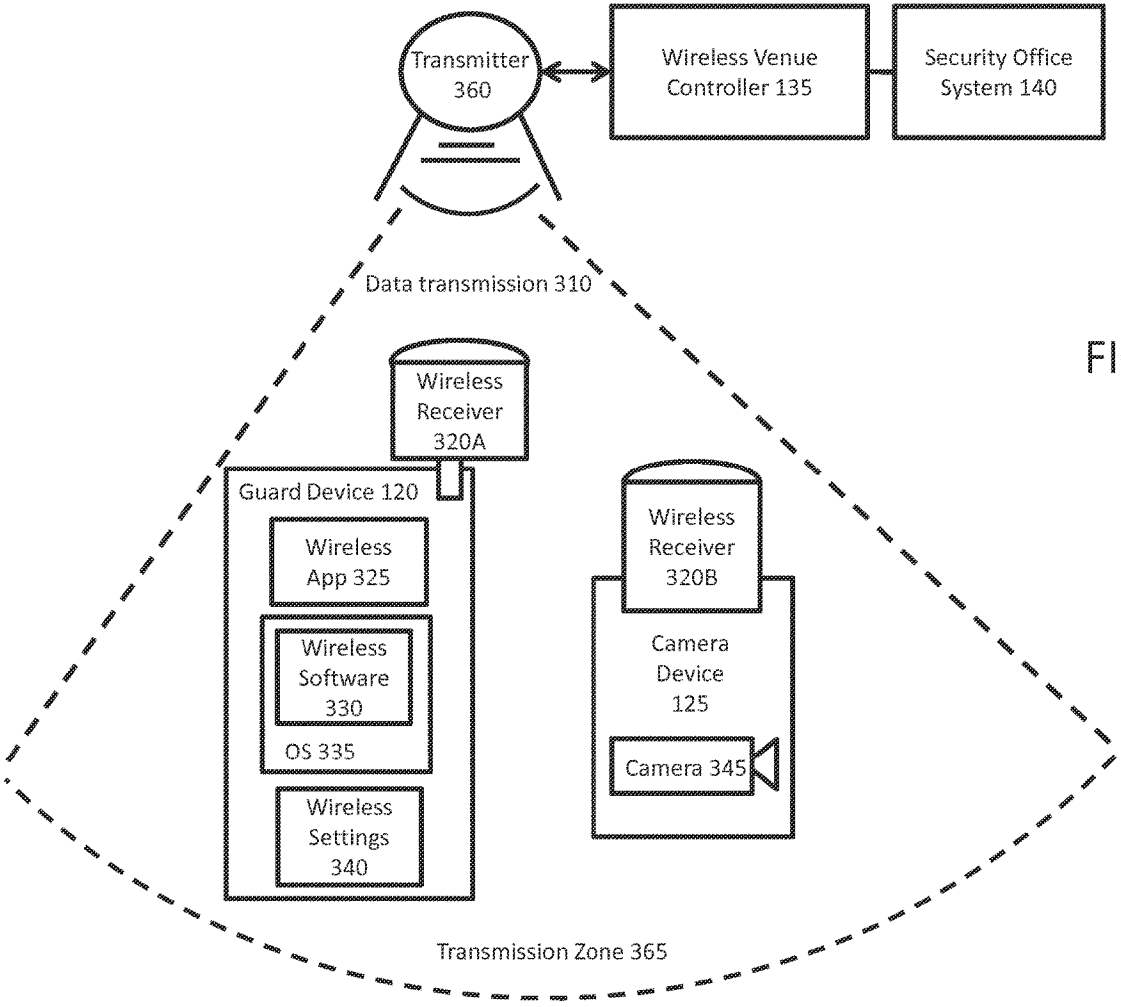
FIG. 3 illustrates an exemplary wireless transmission zone of an exemplary wireless transmitter, with a guard device and a camera device in the transmission zone.

The wireless event venue security system ecosystem of FIG. 1 includes a number of wireless transmitters 105, identified as transmitter 105A, transmitter 105B, transmitter 105C, transmitter 105D, transmitter 105E, and transmitter 105F. The wireless transmitters 105 may transmit data wirelessly as depicted in FIG. 3 using one or more of a variety of wireless communication technologies. For example. The each wireless transmitter 105 may wirelessly transmit data using a Wi-Fi connection module, a 3G/4G/LTE cellular connection module, a Bluetooth connection module, a Bluetooth low energy connection module, Bluetooth Smart connection module, a near field communication (NFC) module, a radio wave communications module, a microwave communications module, a magnetic induction transmitter, a magnetic resonance transmitter, an electromagnetic radiation transmission module, a visible light communication (VLC) transmission lamp/laser/module, a speaker (e.g., audible sound transmitter, ultrasonic transmitter, infrasonic transmitter, with or without noise cancelling features), or some combination thereof. The wireless transmitter 100 may include any number of sub-transmitters.

The transmitters 105 of FIG. 1 may all receive data for transmission from a wireless venue controller 135, which may be a hardware controller associated with the event venue 100 that routes data to the correct transmitter 105 of the transmitters 105A-105F.

The wireless venue controller 135 may in turn receive data from a security office system 140, which may be a computer system 700, or may in some cases include multiple computer systems connected within a private network (e.g., a local area network or wireless local area network) or distributed throughout the Internet. The security office system 140 may execute a wireless messaging center 145, which may be a software application stored in at least one memory of the security office system 140 and executed by at least one processor of the security office system 140.

The security office system 140 may be connected through an Internet connection 150 or a network connection 150 (e.g., through a local area network or wireless local area network) to a law enforcement network 160, a first responder network 165, or a variety of other networks 170. The law enforcement network 160 may include one or more computer systems 700 which may send data to the security office system 140 (e.g., crime alerts near or at the event venue) or receive data from the security office system 140 (e.g., a request for police assistance). The law enforcement network 160 may belong to a local police force, a federal law enforcement agency (e.g., the Federal Bureau of Investigation a.k.a. the "FBI", the Drug Enforcement Agency a.k.a. the "DEA", U.S. Immigrations and Customs Enforcement a.k.a. "ICE", the U.S. Department of Homeland Security a.k.a. the "DHS", the National Guard, or the Coast Guard), or an international or multinational law enforcement agency (e.g., the International Criminal Police Organization a.k.a. "INTERPOL").

The first responder network 165 may include one or more computer systems 700 which may send data to the security office system 140 (e.g., health or safety alerts near or at the event venue) or receive data from the security office system 140 (e.g., a request for firefighter or paramedic/ambulance assistance).

The other networks 170 may each include one or more computer systems 700 which may send data to the security office system 140 or receive data from the security office system 140.

Figure 2:
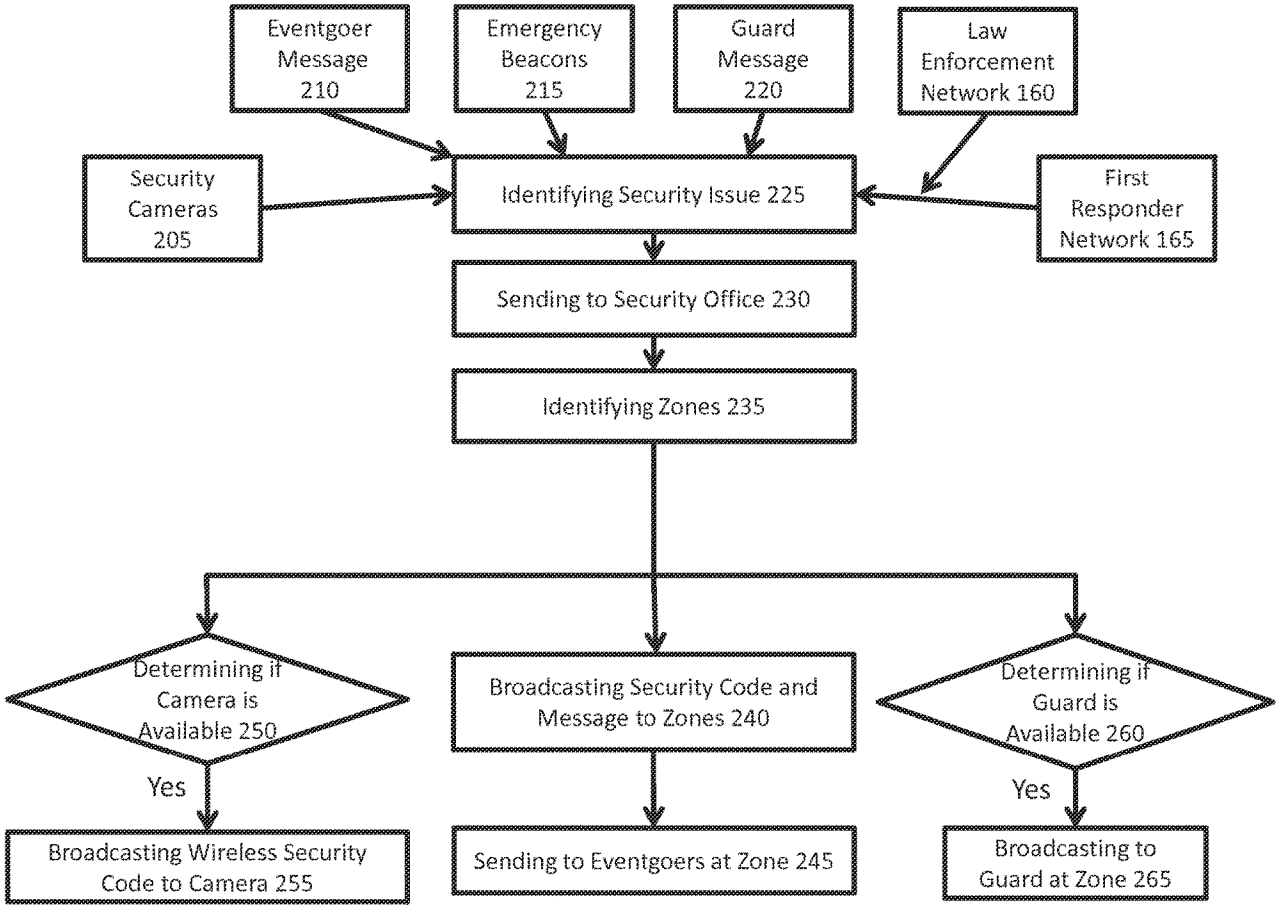
FIG. 2 is a flow diagram illustrating exemplary operations of an event venue security system.

FIG. 2 is a flow diagram illustrating exemplary operations of an event venue security system.

The operations of the event venue security system illustrated in FIG. 2 begin at step 225 with identifying a security issue. A security issue may be identified following receipt of information from one of a variety of sources, by an individual manually parsing the received information to determine that an emergency is occurring or has occurred, or by a computer automatically algorithmically parsing the received information to determine that an emergency is occurring or has occurred.

For example, a security issue may be identified at step 225 following receipt of camera feed information (e.g., a video of an eventgoer stealing merchandise or attacking someone) from security cameras 205, such as camera devices 125A and 125B of FIG. 1. A security issue may also be identified at step 225 following receipt of information from an eventgoer message 210 (e.g., identifying that someone is having a heart attack nearby), such as from a cellular telephone used by the eventgoer. A security issue may also be identified at step 225 following receipt of information from an emergency beacon 215 (e.g., identifying that someone has pulled a fire alarm switch or used a first aid kit). A security issue may also be identified at step 225 following receipt of information from a guard message 220 (e.g., identifying that a guard has called for backup to deal with a brawl that has broken out in a stadium seating area), such as from a guard device 120 used by a guard 115. A security issue may also be identified at step 225 following receipt of information from a law enforcement network 160 (e.g., identifying that a violent criminal is loose near the event venue 100). A security issue may also be identified at step 225 following receipt of information from a first responder network 165 (e.g., identifying that a fire has been reported near the event venue 100).

Once the security issue is identified in step 225, information identifying the security issue (e.g., which may include detailed information such as descriptions or recorded camera feed data) is sent to the security office system 140 in step 230. As illustrated in FIG. 1, the security office system 140 is connected, through a Wireless Venue Controller 135, to a number of wireless transmitters. Each wireless transmitter 105 of the set of wireless transmitters can transmit data to receiving devices within a transmission zone (e.g., see transmission zone 365 of transmitter 360 of FIG. 3). In step 235, the security office system 140 identifies one or more transmission zones (e.g., using the wireless messaging center 145 of FIG. 5) in the event venue 100 through which data identifying and/or describing (e.g., with text, images, video, audio, or some combination thereof) the security issue identified in step 225.

Once the intended transmission zones are identified in step 235, the transmitter(s) associated with those transmission zones can then, at step 240, broadcast a wireless data transmission that includes a security code and a message throughout the zones, which can then at step 245 be received by eventgoers using eventgoer devices (e.g., smartphones, tablet devices, portable media player devices, portable video game console devices, portable e-book reader devices) within the transmission zone(s) identified at step 235.

Once the intended transmission zones are identified in step 235, the security office system 140 can, at step 25, determine if one or more camera devices 125 are available, and if so, the transmitter(s) associated with those transmission zones can then, at step 240, broadcast a wireless security code to the one or more camera devices 125 within the transmission zone(s) identified at step 235.

Once the intended transmission zones are identified in step 235, the security office system 140 can, at step 25, determine if one or more guards 115 and/or guard devices 120 are available, and if so, the transmitter(s) associated with those transmission zones can then, at step 240, broadcast a wireless data transmission (e.g., that may include a security code and/or a message) to the one or more guard devices 120 within the transmission zone(s) identified at step 235.

FIG. 3 illustrates an exemplary wireless transmission zone of an exemplary wireless transmitter, with a guard device and a camera device in the transmission zone. The transmitter 360 of FIG. 3 may be any of the transmitters of FIG. 1 (e.g., transmitter 105A, transmitter 105B, transmitter 105C, transmitter 105D, transmitter 105E) or another transmitter. The transmission zone 365 of FIG. 3 is cone-shaped, but a transmission zone of a wireless transmitter 360 may alternately be substantially spherical, ovoid, cylindrical, cone-shaped, or another shape.

A data transmission 310 may be transmitted by the transmitter 360 within the transmission zone 365 and received by a first wireless receiver 320A of a guard device 120 (e.g., guard device 120A or guard device 120B of FIG. 1) and also received by a second wireless receiver 320B of a camera device 125 (e.g., camera device 125A or camera device 125B of FIG. 1). The first wireless receiver 320A and second wireless receiver 320B may be identical, similar, or different, and may both be a wireless receiver 320 as described in FIG. 4.

The data transmission 310 may be provided to the transmitter 360 by the security office system 140 through the wireless venue controller 135, for example through the operations described in FIG. 2 in an event venue security system architecture similar to the one described in FIG. 1.

The data transmission 310 may be received by the first wireless receiver 320A, which may be part of the guard device 120 or may be a separate device that is coupled to the guard device 120 (e.g., the first wireless receiver 320A may be coupled to the guard device 120 via a port of the guard device 120, such as an audio jack port, a Lightning port, a Universal Serial Bus port, a Firewire port, a Thunderbolt port, or a High-Definition Multimedia Interface port).

The guard device 120 may include a variety of software elements stored in a memory (e.g., a memory 720, a mass storage 730, a portable storage 740, or some combination thereof) and executed by a processor (e.g., a processor 710). The guard device 120 may include, for example, a wireless application ("wireless app") 325, a wireless software 330, an operating system 335, and a set of wireless settings 340.

The data transmission 310 may be received by the second wireless receiver 320B, which may be part of the camera device 125 or may be a separate device that is coupled to the camera device 125 (e.g., the second wireless receiver 320B may be coupled to the camera device 125 via a port of the camera device 125, such as an audio jack port, a Lightning port, a Universal Serial Bus port, a Firewire port, a Thunderbolt port, or a High-Definition Multimedia Interface port).

The camera device 125 may include a variety of elements, such as a camera 345, a microphone, a variety of sensors, and a digital memory and/or analog recording medium as described in relation to FIG. 1.

Figure 4:
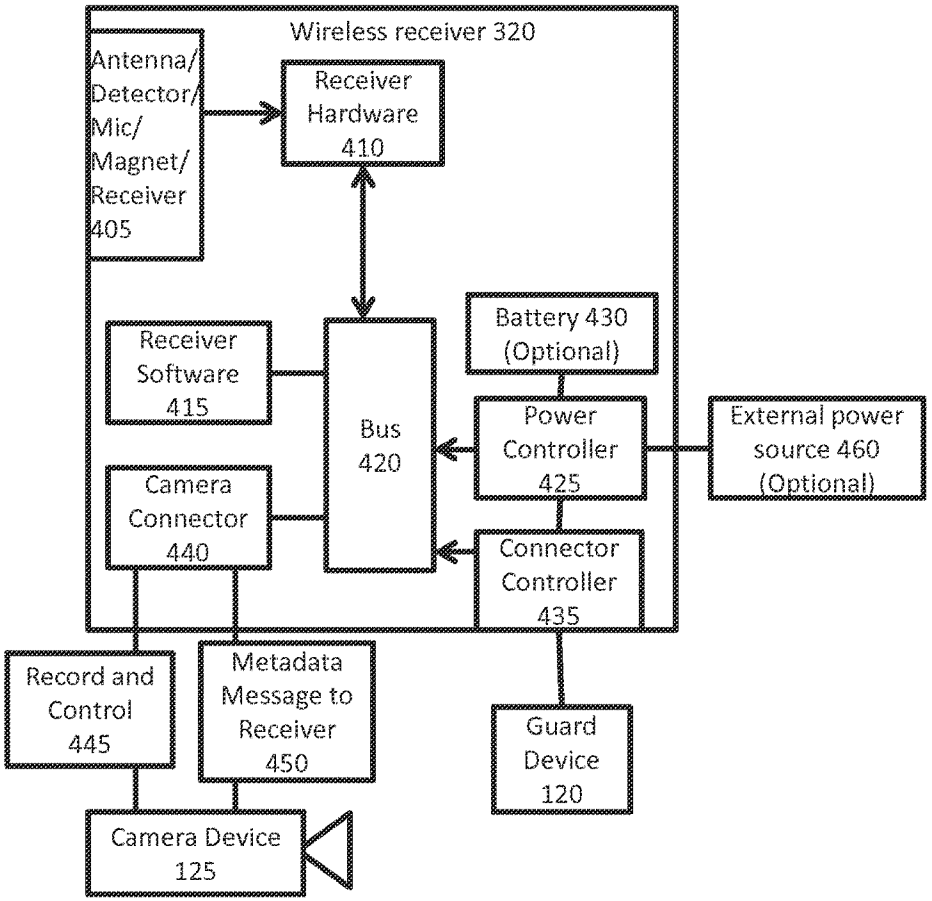
FIG. 4 illustrates an exemplary wireless receiver.

FIG. 4 illustrates an exemplary wireless receiver.

The wireless receiver 320 of FIG. 4 (e.g., which may be the first wireless receiver 320A or the second wireless receiver 320B of FIG. 3 or a different wireless receiver) includes receiver hardware 410, which may include hardware controller hardware (e.g., including data routing, frequency modulation, analog-to-digital converters, digital-to-analog converters, filters, or some combination thereof) as well as one or more particular receiver components 405 that are specific to receiving a particular type of communication, such as antennas (e.g., for receiving radio wave or microwave or cellular or Bluetooth or Wi-Fi communications), photodetectors (e.g., for receiving VLC communications or infrared or ultraviolet communications), microphones (e.g., for receiving audible, ultrasonic, or infrasonic audio-based communications), electromagnets or magnetic coils (e.g., for receiving magnetic resonance or magnetic induction communications), or other components that can be used to receive wireless communications. The receiver components 405 may also include ports for receiving wires communications (e.g., Ethernet ports, fiber optic ports, modem ports).

The wireless receiver 320 of FIG. 4 includes receiver software 415. The receiver software 415 may be used to decode communications and extract messages (e.g., which may include text, images, audio, video, documents, data structures, other software files, other data files, or some combination thereof). Exemplary operations of the receiver software 415 are further illustrated in FIG. 3.

In some embodiments, the wireless receiver 320 may identify whether it is authorized to read a wireless data transmission 310 or whether the wireless data transmission 310 came from the correct wireless transmitter 360 by comparing a security code sent in the wireless data transmission 310 to one stored at the wireless receiver 320. Alternately, a different communication security method can be used, such as via transfer of symmetric encryptions keys, transfer of asymmetric encryption keys (e.g., as part of a public key infrastructure), or transfer of certificates signed by a certificate authority.

The wireless receiver 320 of FIG. 4 includes a connector controller 435, which allows the wireless receiver 320 to be connected to a guard device 120. The wireless receiver 320 may be connected to the guard device 120 via a Universal Serial Bus (USB) cable, a lightning cable, a thunderbolt cable, an audio jack cable, a 30-pin cable, an HDMI cable, or another type of cable, which may be controlled and/or monitored by the connector controller 435. Alternately, the wireless receiver 320 may be connected to the guard device 120 through a wireless connection, which may be short-range or long-range, such as a Bluetooth connection, a magnetic induction connection, a magnetic resonance connection, a radio frequency identification (RFID) connection, or a near-field-communication (NFC) connection, which may be controlled and/or monitored by the connector controller 435.

The wireless receiver 320 of FIG. 4 includes a power controller 425, which may control power input and output for the wireless receiver 320. The power controller 425 may optionally control and/or monitor power input from a battery 430 of the wireless receiver 320, which may be a replaceable battery (e.g., a set of AA or AAA batteries) or a rechargeable battery (e.g., a lead-acid battery, a lithium-ion battery, a nickel-cadmium battery, a nickel-metal hydride battery, a lithium polymer battery, a lithium-sulfur battery, or a sodium-ion battery). The power controller 425 may also optionally control and/or monitor power input from an external power source 460, which may be power from an alternating current power grid socket, a direct current power socket, a generator (e.g., mechanical, chemical, petrochemical, nuclear, solar, wind, hydroelectric), or an external battery of one of the types described in relation to the battery 430.

The wireless receiver 320 of FIG. 4 also includes a camera connector 440, which allows the wireless receiver 320 to be connected to a camera device 125. The wireless receiver 320 may be connected to the camera device 125 via a Universal Serial Bus (USB) cable, a lightning cable, a thunderbolt cable, an audio jack cable, a 30-pin cable, an HDMI cable, or another type of cable, which may be controlled and/or monitored by the connector controller 435. Alternately, the wireless receiver 320 may be connected to the camera device 125 through a wireless connection, which may be short-range or long-range, such as a Bluetooth connection, a magnetic induction connection, a magnetic resonance connection, a radio frequency identification (RFID) connection, a Wi-Fi connection, or a near-field-communication (NFC) connection, which may be controlled and/or monitored by the camera connector 440. The camera connector 440 may have record and control functions 445, allowing the wireless receiver 320 to trigger recording of a camera feed of the camera device 125, or controlling of camera functions (e.g., record, pause recording, move camera using motors/servos) of the camera device 125. The camera connector 440 may have metadata message to receiver functions 450, allowing the wireless receiver 320 to trigger camera metadata (e.g., date information, time information, event information, event venue information, location information, camera direction information, camera movement information, camera input information, transmission zone information, security issue information from step 225 of FIG. 2) to be provided with the camera feed (e.g., overlaid over the camera feed).

Figure 5:
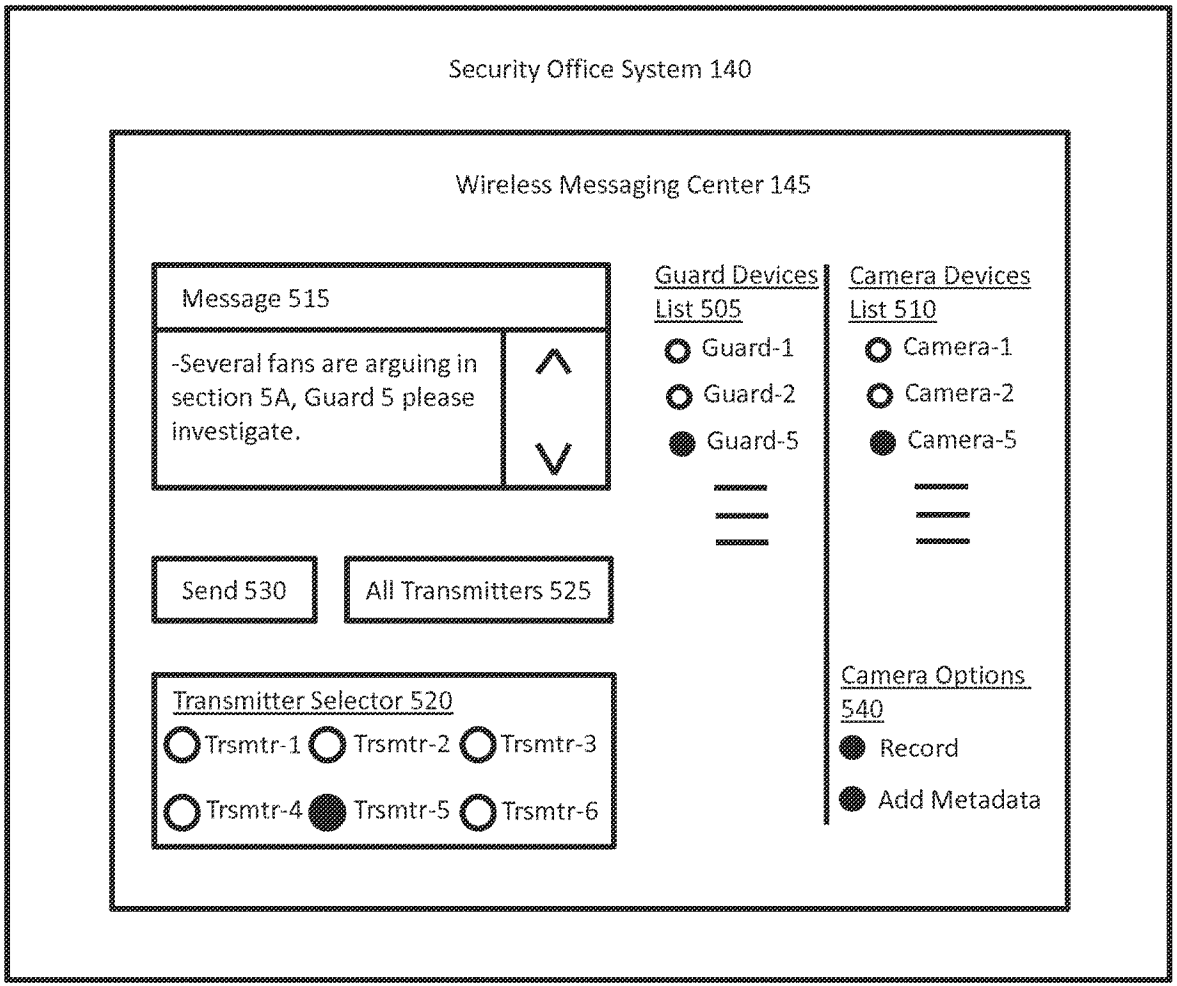
FIG. 5 illustrates an exemplary wireless messaging center interface of an exemplary security office system.

FIG. 5 illustrates an exemplary wireless messaging center interface of an exemplary security office system.

The security office system 140 may execute a wireless messaging center software 145, which may include a graphical user interface (GUI) like the one illustrated in FIG. 5, with various interactive GUI elements.

The GUI of the wireless messaging center software 145 illustrated in FIG. 5 includes a message box 515, into which a message can be input manually by a security manager using the wireless messaging center 145 of the security office system 140, in which an automatically generated message can be displayed before being automatically or manually sent by the security office system 140. The message can be addressed to one or more guard devices 115 as identified in the guard device list 505. For example, the message box 515 of FIG. 5 states "Several fans are arguing in section 5A, Guard 5 please investigate." The message may also include live or pre-recorded camera feed data, such as footage from Camera-5 as identified in the camera devices list 510, as well as other multimedia data (eg., images, videos, audio). The guard device list 505 then identifies that the message should be sent to the guard device 120 associated with Guard 5. A camera devices list 510 also identifies that the that a Camera 5 should be activated and/or should receive the message identified in the message box 515. A transmitter selector 520 identifies that a transmitter identified as Transmitter 5 ("Trsmtr-5") should be used to transmit the message identified in message box 515. A camera options list 540 identifies that the camera(s) identified in the camera devices list 510 (e.g., here Camera 5) should both start recording and add metadata to the recording. The message can then be sent using a "send" button 530. The message can alternately be sent through all transmitters using the "all transmitters 525" button.

The message identified by the message box 515 of FIG. 5 can be sent to all devices in one or more transmission zones (e.g., transmission zones of one or more wireless transmitters), or can be sent to specific devices within those one or more transmission zones. For example, the message may be encrypted (e.g., using a symmetric encryption key infrastructure or an asymmetric encryption key infrastructure such as a public key infrastructure) so that only guard devices can read it (e.g., using a decryption key usable by all guard devices), or protected by a password or key code only accessible by guards or guard devices. The message may alternately be directed at particular devices by first identifying those devices in a whitelist or blacklist, for example via Internet Protocol address (IP address), media access control address (MAC address), serial number, or some other identifier.

The wireless messaging center software 145 may also identify the locations of the guard devices 120 in order to better allow the security office system to manage which guard device(s) 120 should receive the message identified in message box 515. Such locations may be provided by the guard devices 120, which may include global positioning system (GPS) transceivers.

Figure 6:
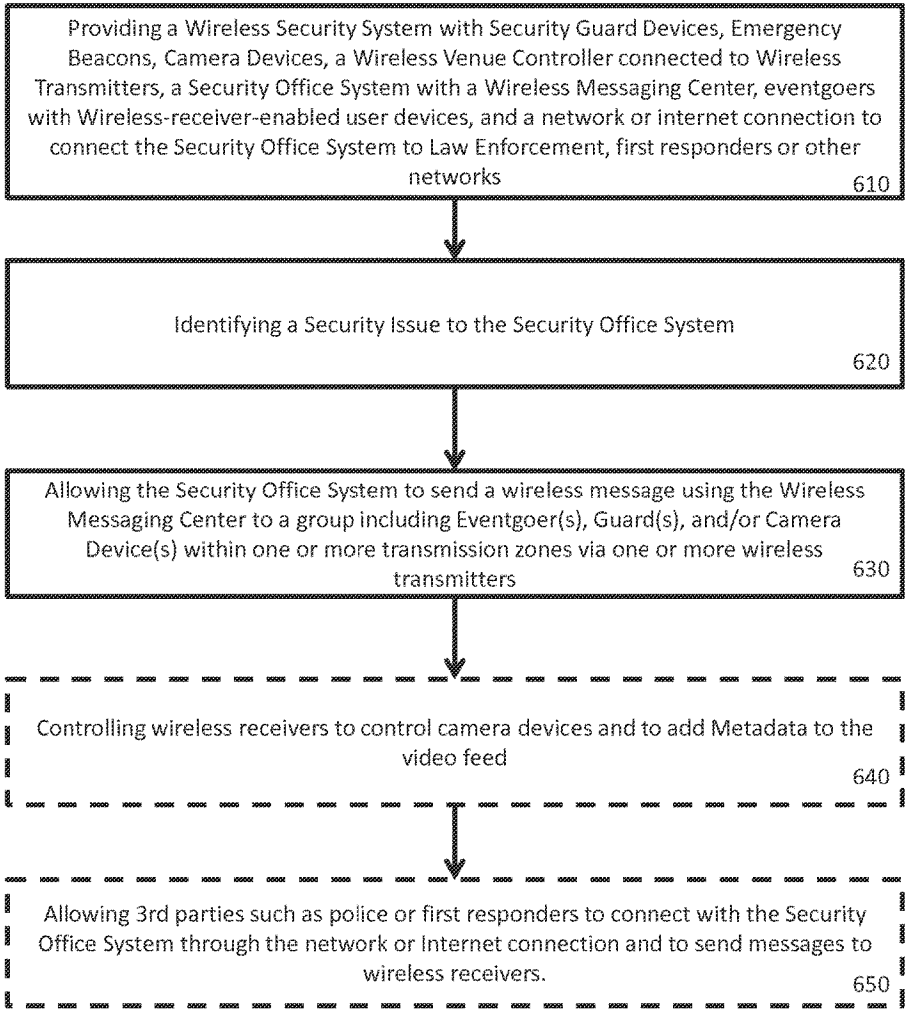
FIG. 6 illustrates an exemplary overall method of the present invention as described herein.

FIG. 6 illustrates an exemplary overall method of the present invention as described herein.

The overall method includes, at step 610, providing a Wireless Security System with Security Guard Devices 120, Emergency Beacons 130, Camera Devices 125, a Wireless Venue Controller 135 connected to Wireless Transmitters 105/360, a Security Office System 140 with a Wireless Messaging Center 145, eventgoers with Wireless-receiver-enabled user devices, and a network or internet connection 150 to connect the Security Office System 140 to law enforcement networks 160, first responder networks 165, or other networks 170.

The overall method includes, at step 620, identifying a Security Issue (e.g., see step 225 of FIG. 2) to the Security Office System 140.

The overall method includes, at step 630, allowing the Security Office System 140 to send a wireless message using the Wireless Messaging 145 Center to a group including Eventgoer(s), Guard(s) 120, and/or Camera Device(s) within one or more transmission zones (e.g., transmission zone 365) via one or more wireless transmitters 105/360.

The overall method includes, at step 640, controlling wireless receivers 320 to control camera devices 125 and to add Metadata to the video feed.

The overall method includes, at step 650, allowing 3rd party networks such as a law enforcement network 160 or a first responder network 165 to connect with the Security Office System 140 through the network or Internet connection 150 and to send messages to wireless receivers 320.

Figure 7:
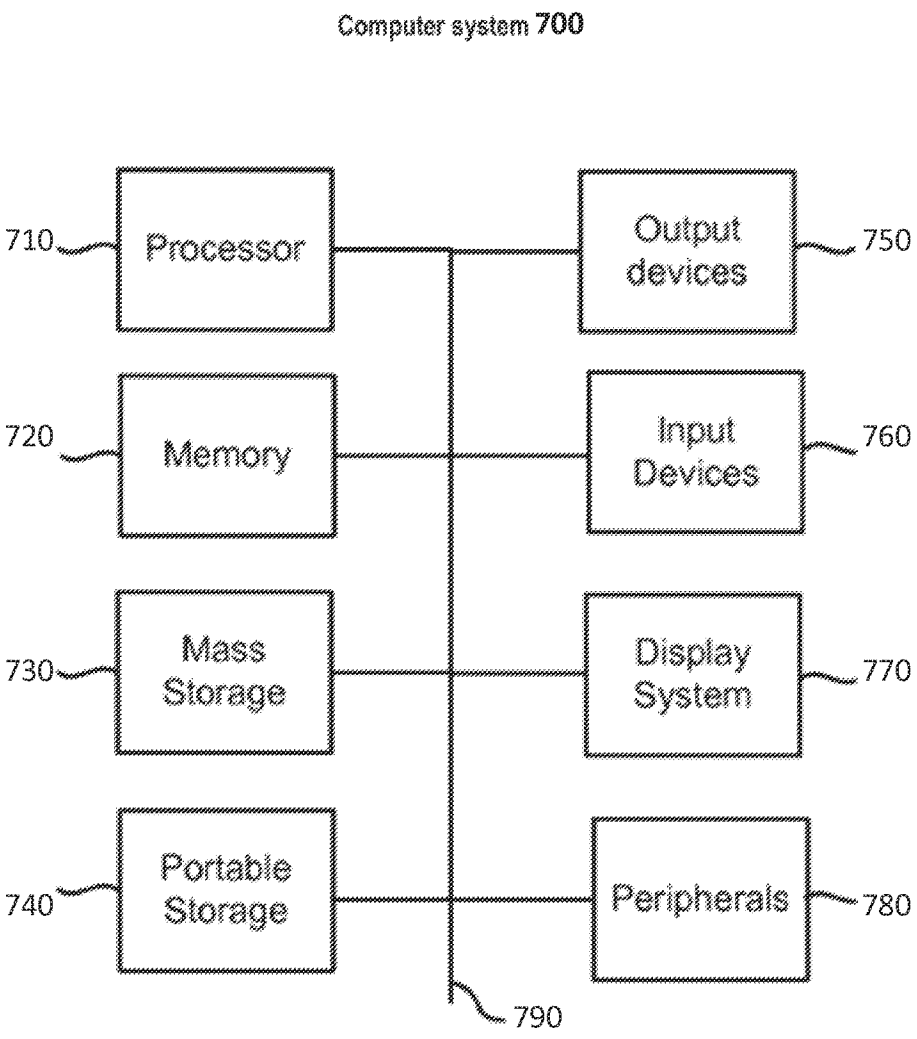
FIG. 7 is a block diagram of an exemplary computing device that may be used to implement an embodiment of the present invention.

FIG. 7 illustrates an exemplary computing system 700 that may be used to implement an embodiment of the present invention. The computing system 700 of FIG. 7 includes one or more processors 710 and memory 710. Main memory 710 stores, in part, instructions and data for execution by processor 710. Main memory 710 can store the executable code when in operation. The system 700 of FIG. 7 further includes a mass storage device 730, portable storage medium drive(s) 740, output devices 750, user input devices 760, a graphics display 770, and peripheral devices 780.

The components shown in FIG. 7 are depicted as being connected via a single bus 790. However, the components may be connected through one or more data transport means. For example, processor unit 710 and main memory 710 may be connected via a local microprocessor bus, and the mass storage device 730, peripheral device(s) 780, portable storage device 740, and display system 770 may be connected via one or more input/output (I/O) buses.

Mass storage device 730, which may be implemented with a magnetic disk drive or an optical disk drive, is a non-volatile storage device for storing data and instructions for use by processor unit 710. Mass storage device 730 can store the system software for implementing embodiments of the present invention for purposes of loading that software into main memory 710.

Portable storage device 740 operates in conjunction with a portable non-volatile storage medium, such as a floppy disk, compact disk or Digital video disc, to input and output data and code to and from the computer system 700 of FIG. 7. The system software for implementing embodiments of the present invention may be stored on such a portable medium and input to the computer system 700 via the portable storage device 740.

Input devices 760 provide a portion of a user interface. Input devices 760 may include an alpha-numeric keypad, such as a keyboard, for inputting alpha-numeric and other information, or a pointing device, such as a mouse, a trackball, stylus, or cursor direction keys. Additionally, the system 700 as shown in FIG. 7 includes output devices 750. Examples of suitable output devices include speakers, printers, network interfaces, and monitors.

Display system 770 may include a liquid crystal display (LCD), a plasma display, an organic light-emitting diode (OLED) display, an electronic ink display, or another suitable display device. Display system 770 receives textual and graphical information, and processes the information for output to the display device. The display system 770 may include touchscreen input capabilities, such as capacitive touch detection.

Peripherals 780 may include any type of computer support device to add additional functionality to the computer system. For example, peripheral device(s) 780 may include a modem or a router.

The components contained in the computer system 700 of FIG. 7 are those typically found in computer systems that may be suitable for use with embodiments of the present invention and are intended to represent a broad category of such computer components that are well known in the art. Thus, the computer system 700 of FIG. 7 can be a personal computer, hand held computing device, telephone, mobile computing device, workstation, server, minicomputer, mainframe computer, or any other computing device. The computer can also include different bus configurations, networked platforms, multi-processor platforms, etc. Various operating systems can be used including Unix, Linux, Windows, Macintosh OS, Palm OS, Android, iOS, and other suitable operating systems.

While various flow diagrams provided and described above may show a particular order of operations performed by certain embodiments of the invention, it should be understood that such order is exemplary (e.g., alternative embodiments can perform the operations in a different order, combine certain operations, overlap certain operations, etc.).

The foregoing detailed description of the technology has been presented for purposes of illustration and description. It is not intended to be exhaustive or to limit the technology to the precise form disclosed. Many modifications and variations are possible in light of the above teaching. The described embodiments were chosen in order to best explain the principles of the technology, its practical application, and to enable others skilled in the art to utilize the technology in various embodiments and with various modifications as are suited to the particular use contemplated. It is intended that the scope of the technology be defined by the claim.

What is claimed is:

1. A method for event venue security, the method comprising:

receiving a security alert identifying a security issue at an event venue;

identifying an issue region of the event venue associated with the security issue, the issue region being one of a plurality of distinct regions of the event venue;

identifying a transmission region of a first wireless transmitter, the transmission region including at least a subset of the issue region of the event venue and including a plurality of mobile receiver devices and a camera device, wherein the first wireless transmitter is a visual light communication (VLC) transmitter that is distinct from the plurality of mobile receiver devices and the camera device, and wherein the plurality of mobile devices is distinct from the camera device;

transmitting a camera trigger from the first wireless transmitter to the camera device, thereby triggering the camera device to start recording a camera feed;

generating an electronic message identifying the security issue, the electronic message including the camera feed;

identifying a set of authorized mobile receiver devices that includes a subset of the plurality of mobile receiver devices;

securing the electronic message, thereby allowing the set of authorized mobile receiver devices to read the electronic message and prohibiting a remainder of the plurality of mobile receiver devices other than the set of authorized mobile receiver devices from reading the electronic message; and transmitting the electronic message from the first wireless transmitter to the transmission region, thereby outputting the electronic message at the set of authorized mobile receiver devices but not at the remainder of the plurality of mobile receiver devices.

2. The method of claim 1, wherein the security issue is a result of an ongoing dangerous occurrence.

3. The method of claim 1, wherein the security issue is a result of a past dangerous occurrence.

4. The method of claim 1, wherein the set of authorized mobile receiver devices includes at least one guard device associated with a security guard.

5. The method of claim 4, wherein the electronic message includes assistance instructions pertaining to the security issue.

6. The method of claim 1, wherein the set of authorized mobile receiver devices includes at least one law enforcement device associated with one of a local police force, a federal law enforcement agency, or an international law enforcement agency.

7. The method of claim 1, wherein the set of authorized mobile receiver devices includes at least one eventgoer device associated with an eventgoer, and wherein the electronic message includes a warning pertaining to the security issue.

8. The method of claim 1, wherein securing the electronic message includes at least one of encrypting the electronic message, password-protecting the electronic message, or some combination thereof.

9. The method of claim 1, wherein the camera feed includes at least one of an image or a video.

10. A system for event venue security, the system comprising:

a first wireless transmitter of a plurality of wireless transmitters, wherein the first wireless transmitter is a visual light communication (VLC) transmitter and transmits to a transmission region that includes a plurality of mobile receiver devices and a camera device, wherein the first wireless transmitter is distinct from the plurality of mobile receiver devices and the camera device, and wherein the plurality of mobile receiver devices is distinct from the camera device; and a security management device, wherein execution of instructions stored in a memory of the security management device using a processor of the security management device:

receives a security alert identifying a security issue at an event venue, identifies an issue region of the event venue associated with the security issue, the issue region being one of a plurality of distinct regions of the event venue, identifies that the transmission region of the first wireless transmitter includes at least a subset of the issue region of the event venue, transmits a camera trigger from the first wireless transmitter to the camera device, thereby triggering the camera device to start recording a camera feed, generates an electronic message identifying the security issue, the electronic message including the camera feed, identifies a set of authorized mobile receiver devices that includes a subset of the plurality of mobile receiver devices, secures the electronic message, thereby allowing the set of authorized mobile receiver devices to read the electronic message and prohibiting a remainder of the plurality of mobile receiver devices other than the set of authorized mobile receiver devices from reading the electronic message, and transmits the electronic message from the first wireless transmitter to the transmission region, thereby outputting the electronic message at the set of authorized mobile receiver devices but not at the remainder of the plurality of mobile receiver devices.

11. The system of claim 10, wherein the security issue is a result of one of an ongoing dangerous occurrence or a past dangerous occurrence.

12. The system of claim 10, wherein the set of authorized mobile receiver devices includes at least one guard device associated with a security guard.

13. The system of claim 12, wherein the electronic message includes assistance instructions pertaining to the security issue.

14. The system of claim 10, wherein the set of authorized mobile receiver devices includes at least one law enforcement device associated with one of a local police force, a federal law enforcement agency, or an international law enforcement agency.

15. The system of claim 10, wherein the set of authorized mobile receiver devices includes at least one eventgoer device associated with an eventgoer, and wherein the electronic message includes a warning pertaining to the security issue.

16. The system of claim 10, wherein securing the electronic message includes at least one of encrypting the electronic message, password-protecting the electronic message, or some combination thereof.

17. The system of claim 10, wherein the camera feed includes at least one of an image or a video.

18. A non-transitory computer-readable storage medium, having embodied thereon a program executable by a processor to perform a method for event venue security, the method comprising:

receiving a security alert identifying a security issue at an event venue;

receiving a security alert identifying a security issue at an event venue;

identifying an issue region of the event venue associated with the security issue, the issue region being one of a plurality of distinct regions of the event venue;

identifying a transmission region of a first wireless transmitter, the transmission region including at least a subset of the issue region of the event venue and including a plurality of mobile receiver devices and a camera device, wherein the first wireless transmitter is a visual light communication (VLC) transmitter that is distinct from the plurality of mobile receiver devices and the camera device, and wherein the plurality of mobile devices is distinct from the camera device;

transmitting a camera trigger from the first wireless transmitter to the camera device, thereby triggering the camera device to start recording a camera feed;

generating an electronic message identifying the security issue, the electronic message including the camera feed;

identifying a set of authorized mobile receiver devices that includes a subset of the plurality of mobile receiver devices;

securing the electronic message, thereby allowing the set of authorized mobile receiver devices to read the electronic message and prohibiting a remainder of the plurality of mobile receiver devices other than the set of authorized mobile receiver devices from reading the electronic message; and transmitting the electronic message from the first wireless transmitter to the transmission region, thereby outputting the electronic message at the set of authorized mobile receiver devices but not at the remainder of the plurality of mobile receiver devices.

* * * * *